United States Patent [19]

Stainbrook et al.

[11] Patent Number: 5,025,991

[45] Date of Patent: Jun. 25, 1991

[54] VALVE ARRANGEMENT FOR A LIQUID DISPENSING DEVICE

[75] Inventors: Marlan L. Stainbrook, Maple Grove; John Rodrigue, St. Paul, both of Minn.

[73] Assignee: Tetra Pak Holdings & Finance S.A., Pully, Switzerland

[21] Appl. No.: 405,970

[22] Filed: Sep. 12, 1989

[51] Int. Cl.[5] ..... B05B 1/34

[52] U.S. Cl. ..... 239/459; 239/533.12; 239/461

[58] Field of Search ..... 251/356, 359; 239/456, 239/459, 451, 453, 461, 533.3, 533.12, 583; 222/564

[56] References Cited

U.S. PATENT DOCUMENTS

| | | | |
|---|---|---|---|
| 1,640,408 | 8/1927 | House | 251/356 |
| 1,713,260 | 5/1929 | Chandler | 239/558 |
| 2,154,875 | 4/1939 | Streby | 239/453 |
| 4,402,461 | 9/1983 | Mosse et al. | 239/453 |
| 4,448,008 | 5/1984 | Pankratz et al. | 53/202 |
| 4,648,421 | 3/1987 | Chant et al. | 239/453 |
| 4,817,688 | 4/1989 | Corniea | 222/381 |
| 4,840,205 | 6/1989 | Drevfors et al. | 142/2 |
| 4,903,740 | 2/1990 | Corniea et al. | 141/1 |

*Primary Examiner*—Donald T. Hajec
*Assistant Examiner*—Kenneth Bomberg
*Attorney, Agent, or Firm*—Burns, Doane, Swecker & Mathis

[57] ABSTRACT

A valve arrangement for a liquid dispensing unit includes a discharge nozzle having a central bore, the bore having a central axis, an inner wall, and an edge forming a valve seat; a movable valve element cooperating with the bore to control liquid flow out of the nozzle; the valve element including a valve stem extending along the central axis; a device for reciprocally moving the valve element along the central axis; a valve base mounted at the end of the valve stem for contacting the valve seat to seal closed the nozzle, the valve base including a shear step at the outer circumferential edge thereof, and a seal area adjacent the shear step for contacting the valve seat for shutting off liquid flow when the valve is in a closed position; a plurality of arms projecting from the valve stem for guiding the valve stem with respect to the inner wall of the bore, the arms being spaced from the valve base; and a single fin extending from an outer periphery of the valve base in a direction perpendicular to the axis of the valve stem for separating the flow of the liquid as the liquid leaves the nozzle.

16 Claims, 2 Drawing Sheets

4
2
6
14
8
26
16
12
10
32
18
20
22

Fig. 2
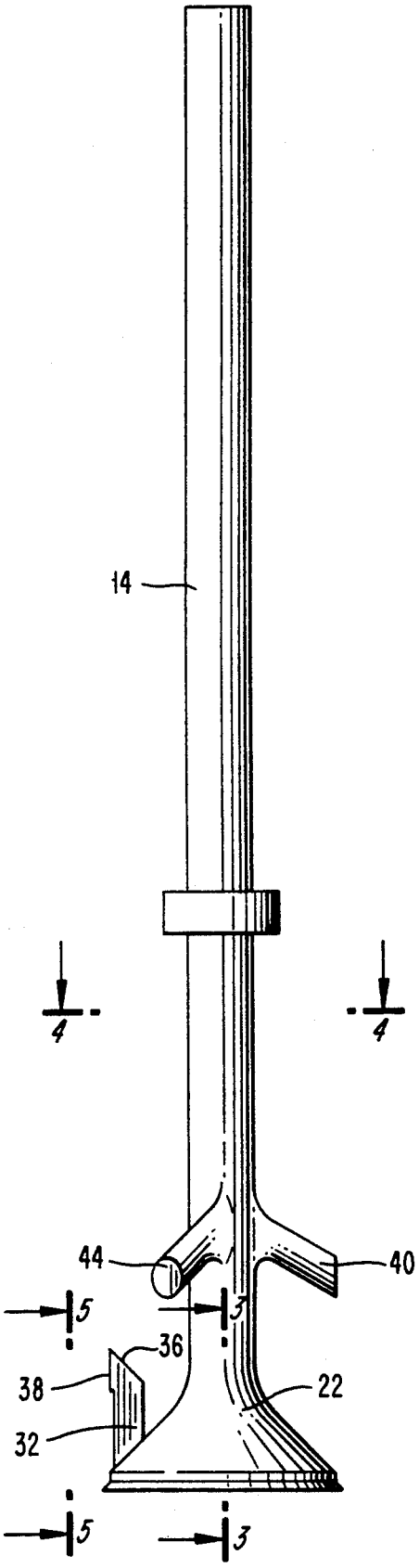
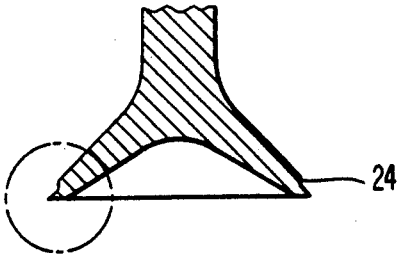
Fig. 3
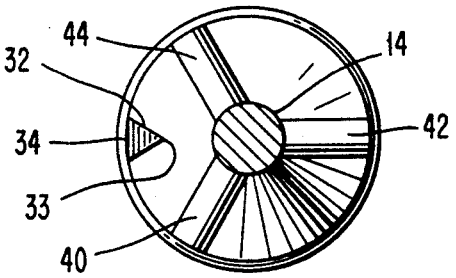
Fig. 4
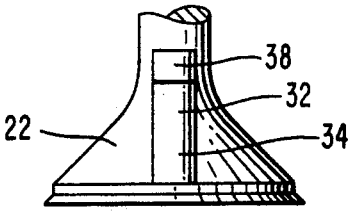
Fig. 5
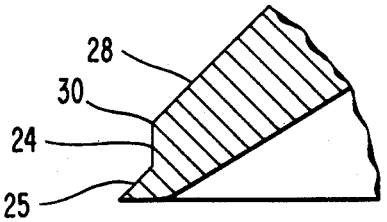
Fig. 6

VALVE ARRANGEMENT FOR A LIQUID DISPENSING DEVICE

BACKGROUND OF THE INVENTION

1. Field of the Invention

The present invention relates to automatic filling machines wherein empty cartons are conveyed along a path while being filled with liquid and then sealed, and more particularly to a valve arrangement for such machines.

2. Description of Related Art

High speed automatic filling machines, such as is disclosed in U.S. Pat. No. 4,448,008, have been used for filling cartons with liquids, such as milk and juices. These filling machines are required to dispense a predetermined quantity of liquid in each carton as it advances through the filling section of the machine.

Such automatic filling machines may be of many different designs, including a double bellows type apparatus, such as those disclosed in U.S. Pat. Nos. 4,402,461 and 4,817,688, or a triple bellows dispensing device, such as those disclosed in U.S. Pat. Nos. 4,840,205 and 4,903,740.

U.S. Pat. Nos. 4,402,461 and 4,817,688 disclose dispensing units having a pair of bellows interconnected by an activator sleeve containing a valve that controls the flow of fluid from the upper bellows to the lower bellows. A discharge valve is mounted at the lower end of the lower bellows. The activator sleeve is mounted for reciprocating movement in an axial direction, and the end of each bellows that is connected with the sleeve moves with it. The opposite ends of the respective bellows are held stationary, so that the axial movement of the body in one direction compresses one of the bellows and expands the other.

The triple bellows dispensing device disclosed in U.S. Pat. No. 4,840,205 includes a valve stem extending axially through at least the lower two bellows. A valve element is mounted at the base of the stem in order to control flow of a liquid through the lowest bellows. The valve element includes radial guides that project radially from the stem and support the stem and the base of the valve element within the nozzle at the base of the lowest bellows.

The triple bellows dispensing device disclosed in U.S. Pat. No. 4,903,740 includes a valve stem extending axially through at least the lowest bellows. A valve element is mounted at the base of the stem in order to control flow of a liquid through the lowest bellows. The valve element includes guide members that extend upwardly from the base of the valve element, parallel to the valve stem. The guide members fit closely within the nozzle opening in order to guide the axial movement of the valve stem through the bellows.

An important function of the radial guides and the guide members of the above-described triple bellows dispensing devices is to separate the liquid flow as the liquid exits the dispensing device in order to allow air to escape from the carton being filled. Unfortunately, the radial guides and the guide members create more turbulence than desired in the liquid as the liquid passes through the valve at the base of the lowest bellows. Thus, although the above-described devices achieve the desirable result of allowing air to escape from the carton while the carton is being filled, the resulting turbulence creates an undesirable amount of foam in the container. In addition, the shape of the base of the valve element causes a small amount of the product to spray, resulting in the seal areas of the carton being filled and adjacent machine surfaces being contaminated with sprayed product.

OBJECTS AND SUMMARY OF THE INVENTION

In view of the deficiencies of prior liquid dispensing units, it is an object of the present invention to provide a liquid dispensing unit that is accurate and efficient in dispensing liquids.

It is a further object of this invention to provide a liquid dispensing unit that is capable of dispensing a liquid product into a container, while allowing air to escape from the container.

A still further object is to provide a liquid dispensing device that dispenses a liquid into a container while creating a minimum amount of turbulence in the liquid.

Another object of the invention is to provide a nozzle for a liquid dispensing unit that minimizes the spray of the liquid during the filling process.

These objects are accomplished according to the present invention by providing a valve arrangement for a liquid dispensing unit that includes a discharge nozzle having a central bore, the bore having a central axis, an inner wall, and an edge forming a valve seat. A movable valve element cooperates with the bore to control liquid flow out of the nozzle. The valve element includes a valve stem extending along the central axis. The valve element is mounted for reciprocating movement along the central axis. A valve base is mounted at the end of the valve stem for contacting the valve seat to shut off flow from the nozzle. The valve base includes a shear step at the outer circumferential edge of the base, and an inner shoulder of the shear step contacts the valve seat to provide a seal when the valve is in a closed position. A plurality of arms project from the valve stem for guiding the valve stem with respect to the inner wall of the bore, the arms being spaced from the valve base. A single fin extends from an outer periphery of the valve base in a direction parallel to the axis of the valve stem for separating the flow of the liquid as the liquid leaves the nozzle.

BRIEF DESCRIPTION OF THE DRAWINGS

A preferred embodiment of the invention is illustrated in the accompanying drawings, in which:

FIG. 2 is a side elevational view of the valve element used in the dispensing unit shown in FIG. 1;

FIG. 3 is a cross-sectional view of the dispensing unit along the line 3—3 in FIG. 2;

FIG. 4 is a cross-sectional view of the dispensing unit along the line 4—4 in FIG. 2;

FIG. 5 is a side elevational view of the dispensing unit along the line 5—5 in FIG. 2; and FIG. 6 is an enlarged detail view of the portion of FIG. 3 that is circled.

DETAILED DESCRIPTION OF A PREFERRED EMBODIMENT

Figure 1:
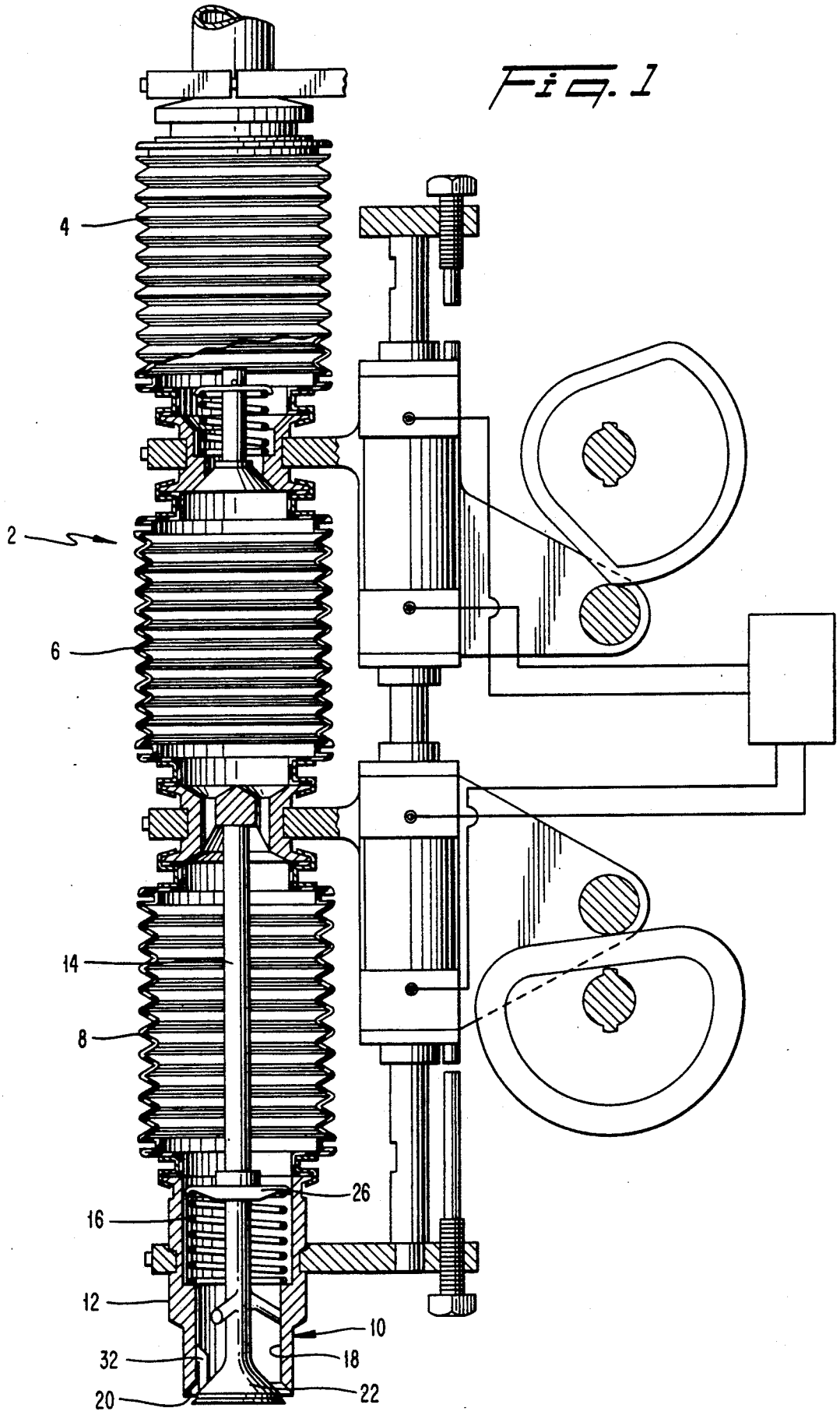
FIG. 1 is a side view, partially in cross-section, showing the valve arrangement of the present invention in use on a triple bellows dispensing unit.

With reference to FIG. 1, a preferred embodiment of the valve arrangement of the present invention is shown installed in a triple bellows dispensing unit of the type disclosed in U.S. Pat. No. 4,903,740. The subject matter of that patent application is incorporated herein by reference. Of course, the valve arrangement of this invention could be incorporated in a double bellows unit, or other dispensing unit having a reciprocating discharge valve of this type.

The dispensing unit 2 includes three bellows 4, 6, 8 through which a liquid to be dispensed passes. A discharge nozzle 10 is mounted at the bottom of the lowest bellows 8. The method of operation of the dispensing unit is described in detail in U.S. Pat. No. 4,903,740, and will thus not be described in further detail herein.

The discharge nozzle 10 includes a cylindrical casing 12 that is fastened to the bottom of the lowest bellows 8 in a known manner. A valve element that includes a valve stem 14 is located within the lowest bellows 8, and is biased toward the closed position by a spring 16 within the casing 12 by means of a circular plate 26 that is fastened to the valve stem 14. The valve stem 14 is moved downwardly, as shown in FIG. 1, to open and upwardly to close. The interior surface 18 of the casing 12 is cylindrical and substantially smooth so as to facilitate the reciprocal movement of the valve element.

A valve seat 20 is provided at the lower end of the casing 12 so as to form a seal with the base 22 of the valve element. As shown more clearly in FIGS. 3 and 6, a shear step 24 is preferably provided at the outer peripheral seal are 25 of the base 22 of the valve element. The purpose of the shear step 24 is to reduce the product flow before the extreme edge of the valve base 22 engages the valve seat 20. This arrangement eliminates or substantially reduces any undesirable spitting or spraying of the product that may contaminate the seal areas of the carton or the adjacent surfaces of the machine.

As an example of the preferred embodiment, the diameter of the valve base 22 is about 2.3 inches, the angle of the valve seat 20 from the longitudinal axis is about 46°, and the height of the shear step 24 as measured along the axis is about 0.030 inches. It has been found that a shear step that is substantially larger does not work as effectively. Thus, when the nozzle moves toward a closed position, the shear step 24 engages the interior of the casing 12 and shuts off flow of the product before the seal area 25 engages the valve seat 20. To facilitate the contact between the valve seat 20 and the valve base 22, a radius of between 0.005 and 0.015 inch may be provided at the intersection 30 of the shear step 24 and the shoulder 28. It has also been found that if the radius is much larger than 0.015 inch, the valve does not work as effectively.

In order to divide, or form a break in, the product flow so as to allow air to escape from the carton while filling the carton with the liquid product, a single fin 32 is located at the outer periphery of the valve base 22 in an axial direction. As seen in FIG. 4, the fin 32 is substantially triangular in cross-section, although the outer wall 34 of the fin 32 is curved so as to conform to the curvature of the outer peripheral edge of the valve base 22. Accordingly, the portion of the fin 32 facing the center of the valve element forms an edge 33 that facilitates dividing the product flow. At the leading edge of the fin 32, a surface 36 slopes toward the center of the valve element at approximately a 45° angle. It is preferred that the lead surface 36 be formed with three sharp corners (see FIG. 4) so as to enhance its ability to split the flow of the liquid product. As seen in FIGS. 2 and 5, a pad or shoe 38 is provided at the outer edge 34 of the fin 32 to engage the interior wall of the casing 12.

Because the present invention uses only one fin to split the flow of the liquid product, there is less cross-sectional area than the above-described devices that use four separate fins to separate the flow. This feature contributes to smoother product flow, resulting in less turbulence and thus less foam in the product that is filled into the container. Also, the sharp vertical edge 33 has the effect of avoiding higher surface tension liquids from rejoining at the edge of the valve element, which would interfere with the escape of air from the container.

To center and guide the valve stem 14 within the nozzle 10, three arms 40, 42, 44 project from the valve stem 14. The three arms 40, 42, 44 extend from the stem 14 at an angle of about 60° from the axial direction of the valve stem 14, and the arms 40, 42, 44 are equally spaced in a radial direction so that they form a 60° angle with respect to each other when viewed from a top view, such as FIG. 4. The length of the arms 40, 42, 44 are designed such that the arms guide the valve element within the inner wall 18 of the case 12.

The arms 40, 42, 44 are separated from the valve base 22 by a distance sufficient such that the disruption or turbulence in the liquid flow is minimized by the time the flow reaches the valve base 22. In a preferred embodiment, the base 22 is at least 1.4 inches from the arms 40, 42, 44, and the top of the arms are located about 2.4 inches from the bottom surface of the valve base 22. That distance enables the product to flow around the arms and then to rejoin with itself before reaching the discharge portion of the valve. The arms 40, 42, 44 are preferably substantially circular in cross-section, again so as to minimize the disruption of the product flow as the product flows past the arms.

Accordingly, the various features described above act individually and in concert so as to improve the flow through the dispensing unit. In particular, the features act to minimize turbulence, and thus foam, as the liquid product flows from the dispensing unit into the cartons to be filled. The features described above also act to reduce splatter of the product as it passes from the dispensing unit into the cartons.

While the present invention has been illustrated in use on a triple bellows dispensing unit, there are many other applications wherein it may be employed. Also, while this invention has been illustrated and described in accordance with a preferred embodiment, it is recognized that variations and changes may be made therein without departing from the invention as set forth in the claims.

What is claimed is:

1. A valve arrangement for a liquid dispensing unit, comprising:

a discharge nozzle casing having a central bore, said bore having a central axis, an inner wall, and an edge of said casing forming a valve seat;

a movable valve element cooperating with said bore to control liquid flow out of said nozzle;

said valve element including a valve base and a valve stem extending along said central axis, said valve element being movable along said central axis;

said valve base being substantially frustoconical and having an outer circumferential edge;

said valve base including a shear step at the outer circumferential edge thereof, and a seal area adjacent said shear step and in position to contact said valve seat to seal said valve in a closed position;

said valve stem having a plurality of arms spaced substantially equally from each other around the valve stem, said arms being positioned to engage the inner wall of said bore, said arms projecting from said valve stem at a location spaced from said valve base, wherein the axial distance between the base of the valve element and the arms is sufficient to enable the liquid to rejoin before reaching the valve base, whereby the turbulence in the liquid flow is minimized.

2. The valve arrangement of claim 1, wherein said plurality of arms comprises three arms extending from said valve stem radially and at an angle of about 60° from the central axis of the valve stem.

3. The valve arrangement of claim 1, wherein the distance between the base of the valve element and the arms is greater than 1.4 inches.

4. The valve arrangement of claim 1, wherein the arms are substantially circular in cross section.

5. The valve arrangement according to claim 1 wherein said shear step is substantially cylindrical and is coaxial with said valve stem, said shear step being positioned to engage the bore of said casing before said seal area engages said seat upon closing movement of said valve element relative to said casing.

6. The valve arrangement according to claim 5 wherein said seal area is substantially frustoconical and concentric with said valve stem, said seal area having an angle of about 46° from said central axis.

7. A valve arrangement for a liquid dispensing unit, comprising:

a discharge nozzle casing having a central bore, said bore having a central axis, an inner wall, and an edge of said casing forming a valve seat;

a movable valve element cooperating with said bore to control liquid flow out of said nozzle;

said valve element including a valve base and a valve stem extending along said central axis, said valve element being movable along said central axis;

said valve base having a seal area in position for contacting said valve seat to shut off liquid flow from said nozzle, said valve base having an outer periphery;

guide means projecting from said valve stem for guiding said valve stem with respect to the inner wall of said bore, said guide means being spaced from said valve base;

spring means for urging said valve element into engagement with said valve seat, said guide means being located between said spring means and said valve element, and fin means extending from the outer periphery of said valve base in a direction substantially parallel to the axis of the valve stem for separating the flow of the liquid as the liquid leaves the nozzle, the remainder of said outer periphery being substantially unobstructed, said fin means being separated from said guide means and said guide means being spaced from said valve seal area a greater distance than said fin means.

8. The valve arrangement of claim 7, wherein said fin means is substantially triangular in cross-section and has a leading edge that slopes downwardly toward the center of the valve element.

9. The valve arrangement of claim 7 wherein said fin means has a sharp edge adjacent said valve stem and said edge extends parallel to said central axis.

10. A valve arrangement for a liquid dispensing unit, comprising:

a discharge nozzle having a central bore, said bore having a central axis, an inner wall, and an edge forming a valve seat;

a movable valve element cooperating with said bore to control liquid flow out of said nozzle;

said valve element including a valve stem extending along said central axis;

means for reciprocally moving said valve element along said central axis;

a valve base mounted at the end of said valve stem for contacting said valve seat to seal closed said nozzle, said valve base having an outer circumferential edge at an outer periphery thereof, said valve base including a shear step at the outer circumferential edge thereof, and an inner shoulder of said shear step contacting said valve seat for purposes of making a seal therewith when said valve is in a closed position;

a plurality of arms projecting from said valve stem for guiding said valve stem with respect to the inner wall of said bore, said arms being spaced from said valve base, the distance between the base of the valve element and the arms being sufficient to enable the liquid to rejoin before reaching the valve base; and single fin means extending from a portion of the outer periphery of said valve base in a direction parallel to the axis of the valve stem for separating the flow of the liquid as the liquid leaves the nozzle.

11. The valve arrangement of claim 10, wherein said plurality of arms comprises three arms extending from said valve stem at an angle of about 60° from the axial direction of the valve stem.

12. The valve arrangement of claim 11, wherein said arms are equally spaced about said valve stem.

13. The valve arrangement of claim 10, wherein the distance between the base of the valve element and the arms is greater than 1.4 inches.

14. The valve arrangement of claim 10, wherein the arms are substantially circular in cross section.

15. The valve arrangement of claim 10, wherein said fin means is substantially triangular in cross-section to form an edge adjacent the valve stem that facilitates dividing the liquid flow between the valve seat and the valve base.

16. The valve arrangement of claim 7 wherein said guide means includes a plurality of arms extending outwardly from said valve stem and engaging said central bore.

* * * * *